US009080246B2

(12) United States Patent
Volkov et al.

(10) Patent No.: US 9,080,246 B2
(45) Date of Patent: Jul. 14, 2015

(54) SELECTIVE PLATING APPARATUS AND METHOD

(71) Applicants: Gennady Volkov, Livingston, NJ (US); David Olshanetskiy, Brooklyn, NY (US)

(72) Inventors: Gennady Volkov, Livingston, NJ (US); David Olshanetskiy, Brooklyn, NY (US)

(73) Assignee: Galvanotech, Linden, NJ (US)

( * ) Notice: Subject to any disclaimer, the term of this patent is extended or adjusted under 35 U.S.C. 154(b) by 85 days.

(21) Appl. No.: 13/650,350

(22) Filed: Oct. 12, 2012

(65) Prior Publication Data

US 2014/0102906 A1 Apr. 17, 2014

(51) Int. Cl.

| | |
|---|---|
| ***C25D 17/06*** | (2006.01) |
| ***C25D 17/02*** | (2006.01) |
| ***C25D 5/04*** | (2006.01) |
| ***C25D 5/02*** | (2006.01) |
| ***C25D 17/28*** | (2006.01) |

(52) U.S. Cl.
CPC *C25D 5/02* (2013.01); *C25D 17/06* (2013.01); *C25D 17/28* (2013.01)

(58) Field of Classification Search
CPC ..... C25D 17/06; C25D 17/02; B65G 29/00
USPC ..... 204/200, 297.01
See application file for complete search history.

(56) References Cited

U.S. PATENT DOCUMENTS

| | | | | |
|---|---|---|---|---|
| 3,657,097 | A | 4/1972 | Baldock et al. | |
| 4,340,449 | A | 7/1982 | Srinivasan et al. | |
| 5,531,312 | A * | 7/1996 | Dickey | 198/450 |
| 7,842,170 | B1 | 11/2010 | von Detten | |
| 2007/0271871 | A1 * | 11/2007 | Spence et al. | 53/201 |
| 2010/0096241 | A1 * | 4/2010 | Lenherr | 198/377.04 |

FOREIGN PATENT DOCUMENTS

| | | | | |
|---|---|---|---|---|
| EP | 0070694 | A1 | 1/1983 | |
| GB | 2104025 | * | 3/1983 | B65G 29/00 |

* cited by examiner

*Primary Examiner* — Keith Hendricks
*Assistant Examiner* — Stefanie S Wittenberg
(74) *Attorney, Agent, or Firm* — Kroub, Silbersher & Kolmykov PLLC; Sergey Kolmykov

(57) ABSTRACT

This invention relates generally to an apparatus and method for electroplating selected portions of a connector part, such as a pin or a socket. The selective plating apparatus of the present invention is capable of continuously depositing plating solution on precisely the right contact surface of the connector part irrespective of its shape and center of gravity. According to the preferred embodiment of the present invention, the selective plating apparatus is capable of plating either side of the connector part, such as a pin or a socket, allowing plating of different type of metals on each side of the machined or stamped parts. The parts are handled automatically with minimum physical stress resulting in more consistent and reliable plating deposits.

17 Claims, 8 Drawing Sheets

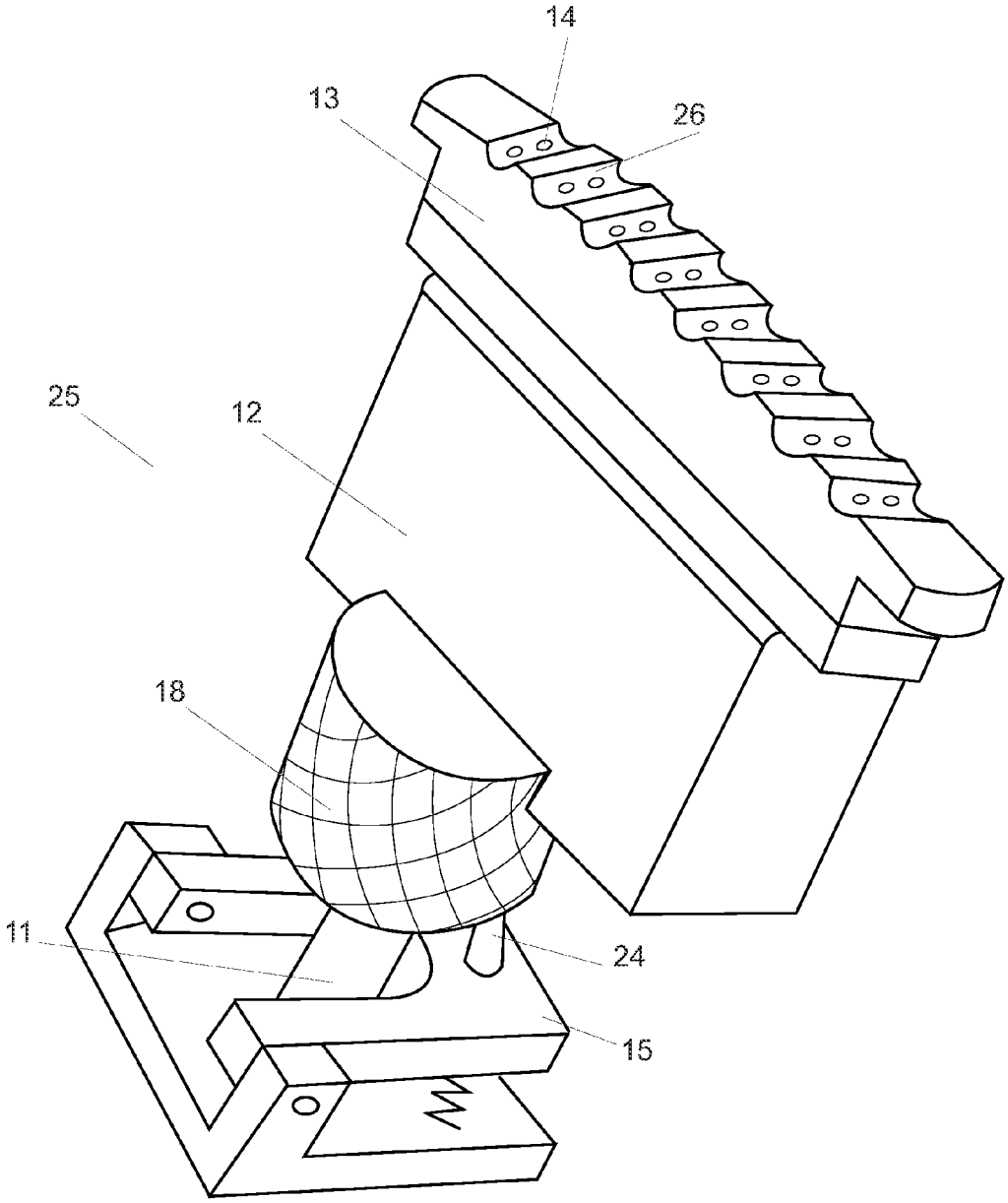
FIG #6

SELECTIVE PLATING APPARATUS AND METHOD

BACKGROUND

I. Field of the Invention

The present invention relates to the field of selective plating, i.e., plating selectively only the contact surfaces of connector parts to the exclusion of other surfaces of the parts.

II. Background of the Related Art

Metal plating is the process of electrolytically depositing a layer of metal onto a part. Engineers and manufacturers often use precious metals, such as gold, silver, platinum, palladium or rhodium, for plating because of their exceptional resistance to corrosion. Precious metal plating also has low contact and electrical resistance making it ideal for electronic applications. Many electronic parts, such as connectors or circuit board components, are plated with precious metals to provide maximum corrosion resistance while maintaining excellent conductivity and solderability.

Generally, coating of many metals can be deposited on other metals, and on non-metals by electroplating (also referred to as electrodeposition), when suitably prepared. This is based on the principle that when direct current power of high enough voltage is applied to two electrodes immersed in a water solution of metallic salt, current will flow through the circuit causing changes at the electrodes. At the negative electrode, or cathode, excess electrons supplied from the power source neutralize positively charged metallic ions in the salt solution to cause dissolved metal to be deposited in the solid state. At the positive electrode, or anode (plating metal), metal goes into solution to replace that removed at the other electrode. For example, if the anode is made of nickel and the cathode is a copper part, then when a current is applied, positively charged ions (small pieces of metal) from the anode flow through the solution to the cathode and attach themselves to the part, producing a layer of nickel on the part. The rate of deposition and the properties of the plated material are dependent on the metals being worked with, the current density, the solution temperature, and other factors. The baths that are used for plating vary from acid to neutral to alkaline with many different chemical formulations involved. Phosphates, sulfates and carbonates, usually of the plating metal, are also commonly added to the electroplating bath. These plating chemicals help to increase and maintain the electric conductivity of the solution.

Controlling the thickness of the electroplated part is generally achieved by altering the time the object spends in the salt solution. The longer it remains inside the bath, the thicker the electroplated shell becomes. The shape of the part will also have an effect on the thickness. Sharp corners will be plated thicker than recessed areas. This is due to the electric current in the bath and how it flows more densely around corners. Before electroplating a part, it must be cleaned thoroughly and all blemishes and scratches should be polished. As described above, recessed areas will plate less than sharp corners, so a scratch will become more prominent, rather than being smoothed over by the plated material.

Another method of plating involves electroless plating which is similar in result to electroplating in that a metallic layer is deposited onto the surface of a part. Electroless plating, however, uses a chemical deposition process—instead of an external electrical current—to achieve the desired result. Electroless plating generally is used for nickel plating, following which a standard chrome plate can be applied to the plastic workpiece in a conventional electroplating bath. Chrome plating plastic offers enhanced protection from corrosion and weather, and plastic or other non-conductive surfaces like fiberglass appear virtually identical to metal workpieces that have been electroplated with chrome.

Many elemental metals and some selected alloys can be used as plating materials. Each material has certain benefits that make it applicable to specific applications. For example, gold is an excellent conductor and resists corrosion caused by formation of oxides that reduce conductivity, so it is often used for electrical contacts and connectors. Other commonly deposited materials include silver, copper, nickel, tin, solder, brass, cadmium, palladium, zinc, etc. Generally, the precious and semi-precious metals are the preferred choice for enhanced conductivity of the connector parts. The high cost of these metals, however, has necessitated precision deposition on the electrical contact surfaces of the parts, while specifically excluding the surfaces of the parts on which plating is unnecessary.

For certain bath and base material combinations it is necessary to create an adherent layer to improve the electroplating process. A strike or a flash is a preliminary electroplating step that applies a thin, but highly adherent layer on the base. A strike serves as a foundation for subsequent plating processes. It uses a high current density and a bath with a low ion concentration. The process is slow, so more efficient plating processes are used once the desired strike thickness is obtained. The striking method is used in combination with the plating of different metals. If it is desirable to plate one type of deposit onto a metal to improve corrosion resistance, but this metal has inherently poor adhesion to the substrate, a strike can be first deposited that is compatible with both. One example of this situation is the poor adhesion of electrolytic nickel on zinc alloys, in which case a copper strike is used, which has good adherence to both.

In the case of gold plating of electrical connectors, e.g., gold-on-copper plating, the copper atoms have the tendency to diffuse through the gold layer, causing tarnishing of its surface and formation of an oxide/sulfide layer. Thus, a layer of a suitable barrier metal, usually a nickel strike, has to be deposited on the copper substrate, forming a copper-nickel-gold sandwich.

Previous prior art plating apparatuses in order to prevent deposition of plating onto the entire part, involved a step of masking the portion of the part which did not require plating by covering it with plugs, caps, resists, or lacquers which are then removed after plating. Masking, however, required another manufacturer operation. Some immersed surfaces are also difficult to mask, particularly the surfaces of small size electrical terminals of various connector pins and sockets. The present invention accomplishes, among other things, selective plating according to an automatic process without a need for masking immersed part surfaces on which plating is unnecessary.

Another prior art solution is to plate the entire part due to its small size irrespective of the actual electrical contact surface. While such solution offers certain simplicity, it greatly increases the amount of plating metal used to cover the entire part. Due to the constant increase in the cost of gold and other precious metals, it has become highly desirable to plate only the selective contact terminals of the part. The present invention reduces the amount of plating metal utilized by more than 80% by selectively plating only the necessary electrical contact terminals of the part.

More recent approaches to selective electroplating solutions have concentrated on building selective plating equipment custom tooled for pin or socket type connectors of particular shape and size. The new selective plating technologies provide the ability to plate only the most critical areas of the part. This ability to precisely control the deposit saves a considerable amount of money by reducing the amount of gold used during the process, while simultaneously enhancing part performance in terms of wear resistance, corrosion resistance, conductivity and solderability. Generally, these modern selective gold plating machines use vibratory or barrel plating using Sulfamate Nickel, followed by a selective gold strike. These prepared parts are then transferred to an automatic or manually loaded selective plating equipment tooled for pin or socket type connectors as shown in FIG. 1 where gold is deposited only where it matters most with regard to performance. Alternatively, selective gold plating of connector pins or sockets can be directly deposited onto Nickel plating without the gold strike.

The problem with the more modern approaches to selective electroplating, however, is the equipment's inability to handle parts of various shapes and sizes. For every new type of connector pin or socket a completely new custom tooled plating machine must be built. This is especially true for the connector parts where the center of gravity is at different locations depending on the shape of the connector part, resulting in the connector part, such as a pin, always turning in one direction which causes the selective plating to be applied on the opposite and the wrong end of the connector. FIG. 1 illustrates different types of pins to be plated with the flanges (shoulders) located at different positions along the length of the pin, thus resulting in different centers of gravity position for each. With the constant improvements in the electronic industry the connector parts never stay the same. The cost of such custom machines is high, thus making the upgrade path cost-prohibitive for the electronics manufacturer, thereby stalling the technological improvements in the electronic equipment. Accordingly, there is an increasing demand for the selective electroplating equipment to handle parts of any shape or size irrespective of their center of gravity.

For example, the EP 0070694, entitled "Conveyor Apparatus For Use In Electroplating And An Electroplating Machine," assigned to Kirkby Process & Equipment Limited, which is incorporated herein by reference in its entirety, discloses a conveyor apparatus which enables the electroplating process to be applied only to a part of a component, leaving the rest uncoated. The conveyor apparatus comprises a rotatable carrier and an endless band which passes around at least part of the circumference of the carrier to hold parts for plating in electrical contact with the carrier. The rotatable carrier is a one-piece metallic wheel whose circumference has a plurality of equi-spaced notches for receiving the parts. The parts to be held by the band pass along a radially disposed stationary channel under the influence of a vibratory feed device. Each part in turn contacts the carrier and is picked up and carried along by one of the notches passing the feed device. A guide disposed immediately adjacent the feed device maintains the articles in contact with the carrier and in the correct axial location until the parts are in a position to be contacted and thereby gripped by the band. Notably, the guide has a shoulder with which the parts engage prior to being held by the band and this should ensure that successive parts are all similarly positioned axially with respect to the carrier wheel. The problem with this approach is that parts are always positioned and turned in the same exact orientation based exclusively on their center of gravity. Therefore, the parts will always be oriented in such a way as to apply the plating onto the heavier end of the part. Such prior art solution leads to plating of the wrong contact surface of differently shaped parts with different centers of gravity. Moreover, since the parts are always turned in only one direction, plating is limited to only one side of the part.

Another disadvantage of the above-mentioned approach is the carrier's handling of the parts exclusively via the physical notches or grooves on the carrier. While the parts may fit perfectly within the precision tooled grooves, such constant physical friction between the grooves and the parts causes unnecessary stress on the parts resulting in their damage or scratches which lead to uneven plating.

The present invention is characterized in that connector parts of various shapes and sizes can be automatically and continuously fed to the electroplating equipment without unnecessary physical stress on the parts. The electroplating apparatus of the present invention efficiently deposits plating metal only onto the necessary electrical point of contact of the parts irrespective of their center of gravity. Thus, either side of the part may be plated.

SUMMARY

A selective plating apparatus for plating contact surfaces of parts using a plating solution bath is disclosed. The plating solution is sometimes referred to as the galvanic bath which is an electrolyte solution containing one or more dissolved metal salts as well as other ions that permit the flow of electricity. The parts to be plated may be of any material, including metallic, non-metallic or alloys. In accordance with the preferred embodiment of the present invention, the parts are electrical connector parts commonly used in electronics applications where the contact surfaces carry an electric current. These parts are electroplated using a commonly known process called electrodeposition. The part to be plated is the cathode of an electrical circuit. The anode of the circuit is made of the metal to be plated on the part. Both, the cathode and the anode are immersed in the electrolyte solution. To activate the circuit, a power supply, such as a battery or a rectifier, supplies a direct current to the anode, oxidizing the metal atoms that comprise it and allowing them to dissolve in the solution. At the cathode, the dissolved metal ions in the electrolyte solution are reduced at the interface between the solution and the cathode, such that they "plate" onto the cathode.

The apparatus comprises a vibrobowl for storing and separating the loose parts; a vibratory linear feeder attached to the vibrobowl for moving the parts via linear vibration, wherein the linear feeder includes a custom product guide for holding the parts; a support wheel for continuously and rotationally moving the parts from the linear feeder to the plating solution bath for plating; a plurality of rotary mechanisms attached to the support wheel along the circumference for receiving the parts from the vibratory linear feeder and for rotating the parts based on the contact surface to be plated; and a pressure belt attached to the support wheel for holding the electrical parts during movement and plating.

The contact surfaces of the parts may be interior or exterior, such as in the case of sockets and pins, respectively. The selective plating apparatus further comprises a vacuum chamber underneath the support wheel for generating air pressure throughout the selective plating apparatus. The support wheel may also include vacuum holes for holding the parts via the air pressure generated by the vacuum chamber. The air pressure holds the parts on the support wheel until the pressure belt takes over. The selective plating apparatus further comprises a plurality of pulleys for providing tension to the pressure belt and a drive system for electrically driving the pressure belt around the support wheel. The selective plating apparatus may further comprise a plating tank housing the plating solution bath for plating the parts. A sump tank comprising a pump pumps the plating solution into the plating tank. The selective plating apparatus further comprises a face cam in contact with the plurality of the rotary mechanisms during the rotation of the support wheel for rotating the parts. The face cam includes a friction plate for making contact with the rotary mechanism. According to another embodiment of the present invention, the face cam includes a gear on rack device for making contact with the rotary mechanism. The plating solution bath may include a precious metal such as gold, silver, platinum, palladium or rhodium, or a non-precious metal. The selective plating apparatus may further comprise a plurality of profile inserts placed in between the rotary mechanisms to close gaps.

A method of selectively plating contact surfaces of parts using a plating solution bath is also disclosed. The method comprises the steps of storing and separating the parts via vibration; moving the separated parts via linear vibration to a support wheel; receiving the parts from a vibratory linear feeder and attaching the parts onto a rotary mechanism using air pressure; rotating the parts based on the contact surface to be plated; and continuously and rotationally moving the parts along the circumference of the support wheel to the plating solution bath for plating.

A rotary mechanism for use with the selective plating apparatus is also provided, comprising a rotary attachment base (12) attached to a support wheel (8), an interchangeable segment (13) attached to the attachment base (12) with custom grooves containing holes (14) for holding the parts via vacuum air pressure, a friction roller or gear (18) for rotating the attachment base (12) with the interchangeable segment (13), a spring holder (15) for disengaging a locking pin from the friction roller or gear (18) via the rotation of the support wheel (8), a hollow shaft (11) interconnecting the attachment base, the interchangeable segment, the friction roller or gear and the spring holder to the support wheel, wherein air vacuum pressure is created within the hollow shaft for attaching the parts onto the support wheel, thus minimizing the unnecessary physical contact with the parts.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings:

FIG. 6 illustrates a three dimensional view of the rotary mechanism according to the preferred embodiment of the present invention.

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should not be taken as limiting the invention as defined in the following.

DETAILED DESCRIPTION

One embodiment of the present invention provides a selective plating apparatus and method of use of such apparatus that yields advantages not taught by the prior art. The selective plating apparatus of the present invention is capable of plating individual connector parts by applying the plating to discrete electrical contact areas of the connector parts. The apparatus is capable of selectively plating individual connector parts simultaneously, complete and at high speed. The apparatus also assures that individual connector parts are plated at uniform thickness of plating.

Furthermore, one embodiment of the present invention provides a selective plating apparatus and method of plating which assure that the connector parts of various dimensions, shapes and configurations respectively can be plated without the need for labor intensive changes between production batches of connector parts, thus resulting in maximization of efficiency, reduction in labor and reduction in capital expenditures for the plating equipment. The selective plating apparatus of the present invention is capable of continuously depositing plating solution on precisely the right contact surface of the connector part irrespective of its shape and center of gravity. According to the preferred embodiment of the present invention, the selective plating apparatus is capable of plating either side of the connector part, such as a pin or a socket, allowing plating of different types of metals on each side of the machined or stamped parts. The parts are handled automatically with minimum physical stress resulting in more consistent and reliable plating deposits.

Figure 2:
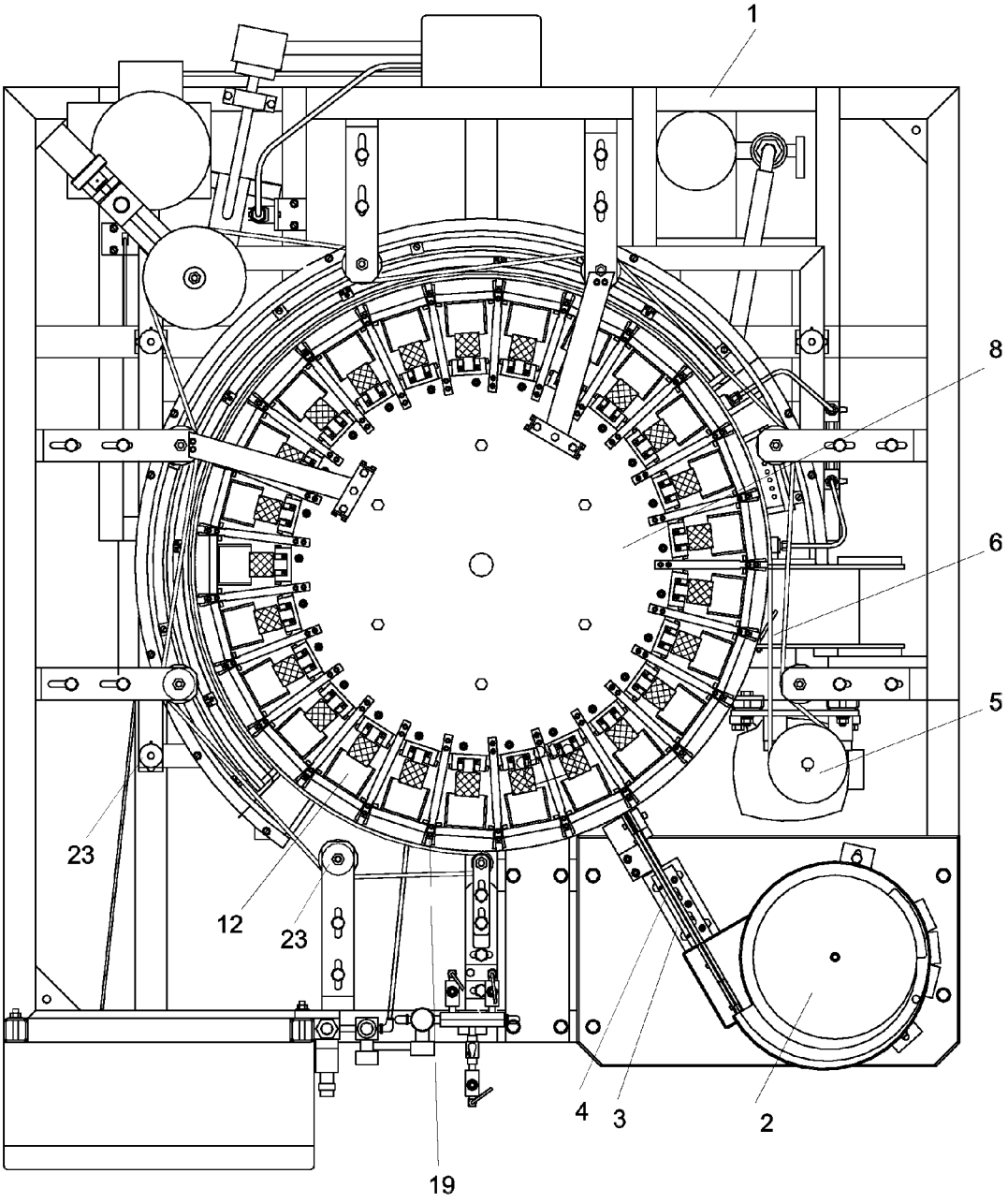
FIG. 2 illustrates a top cross-sectional view of the selective plating apparatus of the present invention.

FIG. 2 is a top cross-sectional view of the selective plating apparatus of the present invention for selective plating of loose connector parts such as pins or sockets. The selective plating apparatus includes frame 1 which supports a vibrobowl 2, a linear vibratory feeder 3 with a product guide 4 positioned on top of the feeder, a drive system 5, a support wheel 8 and a pressure belt 6 for positioning and transfer of parts.

The vibrobowl 2 functions as a container for loose connector parts prior to being picked up by the linear vibratory feeder 3 with a product guide 4. The vibrobowl 2 rotationally vibrates to separate the loose parts and orient them in a proper direction to be fed onto the product guide 4. The loose parts fed into the vibrobowl 2 may be pre-plated with nickel and gold strike as described in the background.

Figure 1:
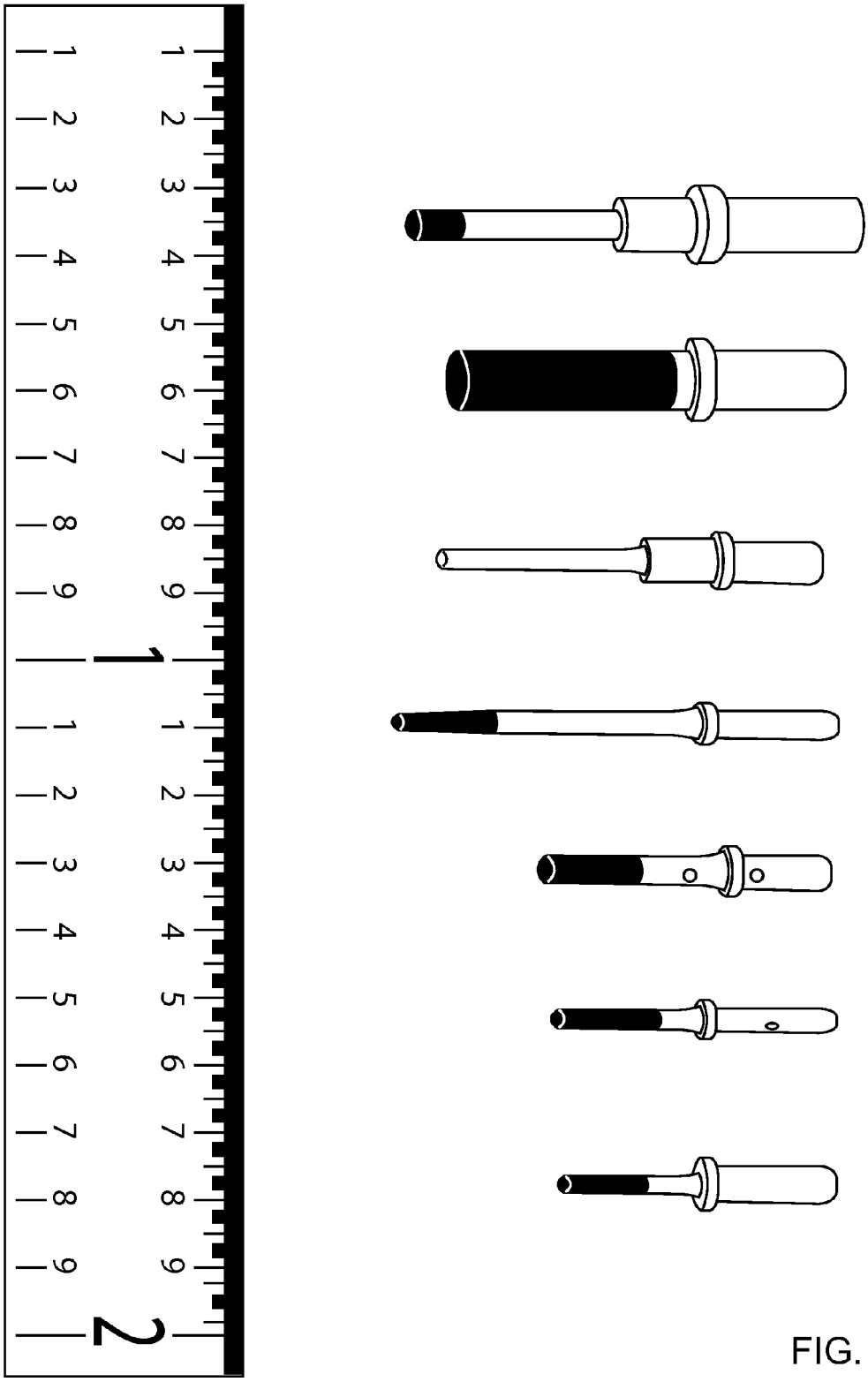
FIG. 1 illustrates examples of various connector parts which can be plated in accordance with the teachings of the present invention.

The linear vibratory feeder 3 is disposed in the portion of the circumference of the support wheel which is not engaged by the pressure belt 6. The feeder 3 is mounted in the stationary frame 1. The product guide 4 is mounted on top of the linear vibratory feeder 3 and comprises a longitudinal channel disposed perpendicularly to the axis of the support wheel 8. The channel has a custom width dimensioned to freely receive the parts to be plated, such as pins or sockets. As illustrated in FIG. 1, some pins have a flange which rests on the upper surface of the channel and the placement of the flange determines the axial position of the pins with respect to the support wheel 8. The feeder 3 vibrates linearly/horizontally to move the parts supported by the product guide 4 onto the support wheel 8. The product guide 4 vibrates synchronously along with the linear feeder 3. Based on their center of gravity, the connector parts turn in a vertical orientation inside the product guide 4. The connector parts are caused to move along the longitudinal channel of the product guide 4 towards the support wheel 8 under the influence of the driving force generated by the vibration of the vibrobowl 2 or the linear vibration of the feeder 3 or a combination of both.

In accordance with the preferred embodiment of the present invention the support wheel 8 is a one piece stainless steel disc with a plurality of equidistant rotary mechanisms attached thereto along the wheel's circumference. The rotary mechanisms receive the parts from the vibratory linear feeder 3 and rotate the parts 180 degrees based on the contact surface to be plated. Alternatively, to ensure the electrical connection, only the outer rim of the support wheel needs to be metallic. Thus a composite support wheel may be utilized. In another embodiment, only the rotary mechanism is metallic while the support wheel along with the frame is made of composite material.

The support wheel 8 is mounted onto the frame 1 so as to rotate about a central axis. The pressure belt 6 which may be made of rubber, PVC or other flexible plastics extends around a major portion of the circumference of the support wheel 8, is driven by and passes around the drive system 5 such that the outer surface of the pressure belt contacts the support wheel 8. One or more of pulleys 23 are disposed around the periphery of the support wheel 8 to maintain the axial location of the pressure belt 6 with respect to the support wheel 8. Pulleys 23 may be idle to provide tension and guidance to the belt. An end pulley is mounted onto the drive system 5 which is fixed in frame 1 and driven by an electric motor (not shown). The speed rotation may be varied. Tension in the pressure belt 6 causes the support wheel 8 to be rotated when the end pulley on top of the drive system 5 is being driven.

The apparatus according to the present invention has the advantage that the shape or size of the parts to be plated is not essential to ensure plating of the correct contact surface. Regardless of the parts' center of gravity the apparatus will always plate the correct electrical contact surface of the parts using the rotary mechanism 25 of the present invention. For instance, parts with flanges in any position may be accommodated in the apparatus. Even parts without any flanges may be accommodated by a combination of the air vacuum and the tension of the pressure belt 6 which serve to grip the parts and hold them in contact with the support wheel 8.

Figure 4A:
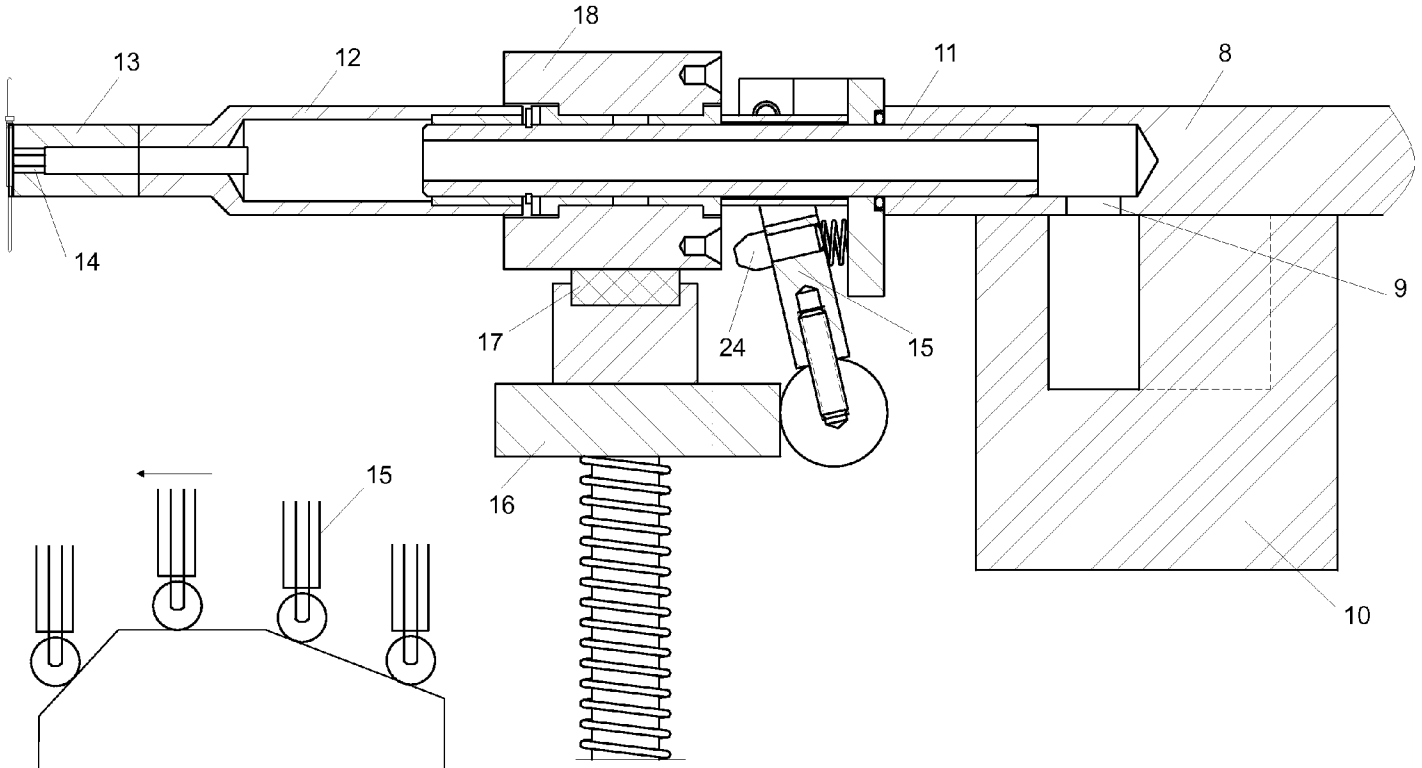
FIGS. 4A and 4B illustrate a side cross-sectional view of the exemplary rotary mechanism in operating condition.
Figure 4B:
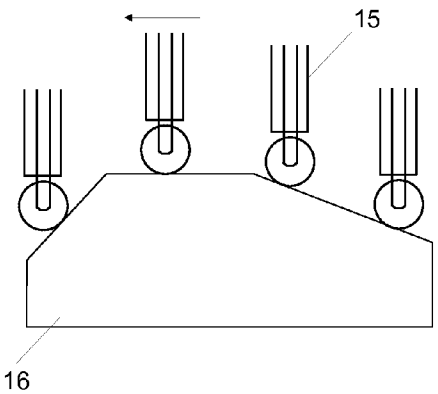
Figure 5:
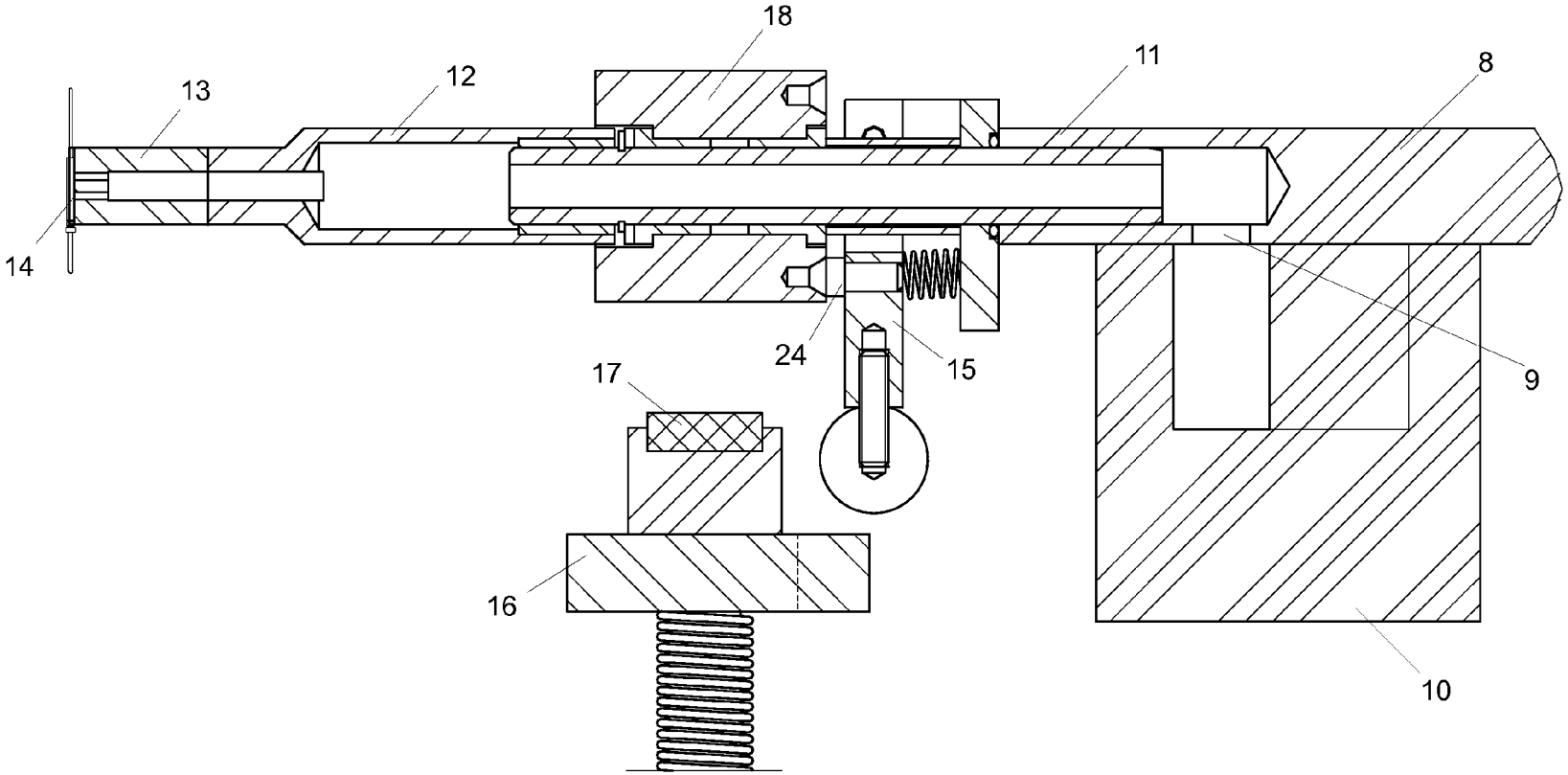
FIG. 5 illustrates a side cross-sectional view of the exemplary rotary mechanism in non-operating condition.

In accordance with another embodiment of the present invention, the selective plating apparatus also includes a vacuum chamber 10 as illustrated in FIGS. 4 and 5. The vacuum chamber 10 is mounted underneath the support wheel 8 with vacuum hole 9 connecting the vacuum chamber 10 and the hollow shaft 11 of the rotary mechanism 25. The vacuum chamber 10 generates air intake pressure which operates throughout the entire support wheel 8 and the plurality of rotary mechanisms 25 attached to the wheel. Preferably, the support wheel 8 includes one or multiple hollow air paths which lead to the rotary mechanisms 25 for holding the parts. The vacuum chamber 10 starts operating prior to the loading of the parts into the vibrobowl 2. The air suction pressure running throughout the plating apparatus is strong enough to hold the parts on the interchangeable segment 13 of the rotary mechanism 25 during rotational transfer of the parts to the pressure belt 6. The air suction pressure is also strong enough to grasp the part from the product guide 4 of the vibratory linear feeder 3.

In accordance with the preferred embodiment of the present invention, a plurality of equidistant rotary mechanisms 25 are positioned on the periphery circumference of the support wheel 8. One example of the preferred embodiment of the rotary mechanism 25 is depicted in FIG. 6. In accordance with one embodiment of the present invention, the rotary mechanism 25 comprises a rotary attachment base 12 which is attached to a support wheel 8 through the hollow shaft 11. The rotary attachment base 12 accommodates a variety of interchangeable segments 13 which are attached thereto and can be replaced based on the shape and dimensions of the parts being plated. Preferably, the interchangeable segment 13 is a stainless steel custom machined segment. A plurality of equally spaced semicircular grooves 26 are formed in the periphery of the interchangeable segment 13. These grooves extend the axial depth of the segment. Alternatively, the grooves may be V-shaped so as to accommodate different sizes of parts. In addition to the grooves 26 the interchangeable segment 13 may include vacuum holes 14 connected with the hollow shaft 11 running through the attachment segment 12 to hold the parts via air suction pressure generated by the vacuum chamber 10.

The rotary mechanism 25 also includes a friction roller or gear 18 for rotating the attachment base 12 with the interchangeable segment 13. The attachment base 12 is rotated 180 degrees to plate the opposite side of the part if necessary. The rotary mechanism 25 also comprises a spring holder 15 for disengaging a locking pin 24 from the friction roller or gear 18 via the rotation of the support wheel 8. The hollow shaft 11 interconnects the attachment base 12, the interchangeable segment 13, the friction roller or gear 18 and the spring holder 15 to the support wheel 8, wherein air pressure is created within the hollow shaft 11 for attaching the parts onto the interchangeable segment 13 and thus onto the support wheel 8 for transfer to the plating solution bath.

The function of the rotary mechanism 25 will now be described with reference to FIGS. 4 and 5. In accordance with the preferred embodiment of the present invention, the selective plating apparatus may also include a face cam 16 with a friction plate 17 fixed onto the frame 1. If necessary, the face cam 16 may be raised or lowered via a spring. The spring is raised when the part to be plated must be turned by 180 degrees. Thus, when the part's center of gravity turns the part the wrong way which would result in the opposite end of the part to be plated, the part must be turned over. The turning of the part is activated by the friction plate 17 making contact with the friction roller 18 of the rotary mechanism 25. The contact of the friction plate with the friction roller may be in the form of a gear on rack device, a ratchet or other similar means of achieving rotation. FIGS. 4A and 4B illustrate the function of the rotary mechanism in an unlocked working position. As the support wheel 8 rotates around its axis the face cam 16 makes contact with the spring holder 15 which disengages the locking pin 24 from the friction roller 18, thus allowing the friction roller 18 to rotate the rotary attachment base 12 with the interchangeable segment 13 holding the part. Preferably the face cam 16 makes contact with the spherical end of the spring holder 15 resulting in smooth engaging and disengaging of the locking pin 24. When the locking pin 24 is disengaged the spring holder 15 is forced by the face cam 16 to compress its spring against the wall of the rotary mechanism. FIG. 5 illustrates the rotary mechanism in a locked non-working position. As shown, the friction roller 18 includes a cavity for hosting the locking pin 24 in a locked position. In this locked position, when the rotation of the part is unnecessary, the lowered face cam 16 does not contact the spring holder 15 and the friction plate 17 is disconnected from the friction roller 18 resulting in a fixed roller position.

Referring to FIG. 6, a connector part, such as a pin or a socket, at the end of the channel in the product guide 4 contacts the outer interchangeable segment 13 of the rotary mechanism 25 and is received in one of the grooves 26 causing that part to move with the support wheel 8. Preferably, the part is pulled by the air pressure created inside the vacuum holes 14 of the grooves 26 in the interchangeable segment 13 thus minimizing the physical stress on the part and avoiding unnecessary risk of damage to the part.

The air pressure inside the hollow shaft 11 generated by the vacuum chamber 10 holds the parts until the pressure belt 6 of the support wheel 8 takes over and completely covers the part. Thus, the axial position of the parts is maintained. The vacuum chamber 10 is positioned underneath the support wheel 8 with vacuum tubes connected to the hollow shaft 11. Thus, the parts are automatically and continuously fed to the rotary mechanism 25 mounted on the periphery of the circumference of the support wheel 8 where they are picked up by the grooves 26 and the air pressure from the holes 14 running throughout the support wheel 8 and the rotary mechanism 25 and passed on to the pressure belt 6 which is under tension. The parts in the held position project downwardly from the support wheel 8 so that they can be passed into one or more plating baths of tank 7. Alternatively, a plurality of plating tanks may be utilized.

Figure 7A:
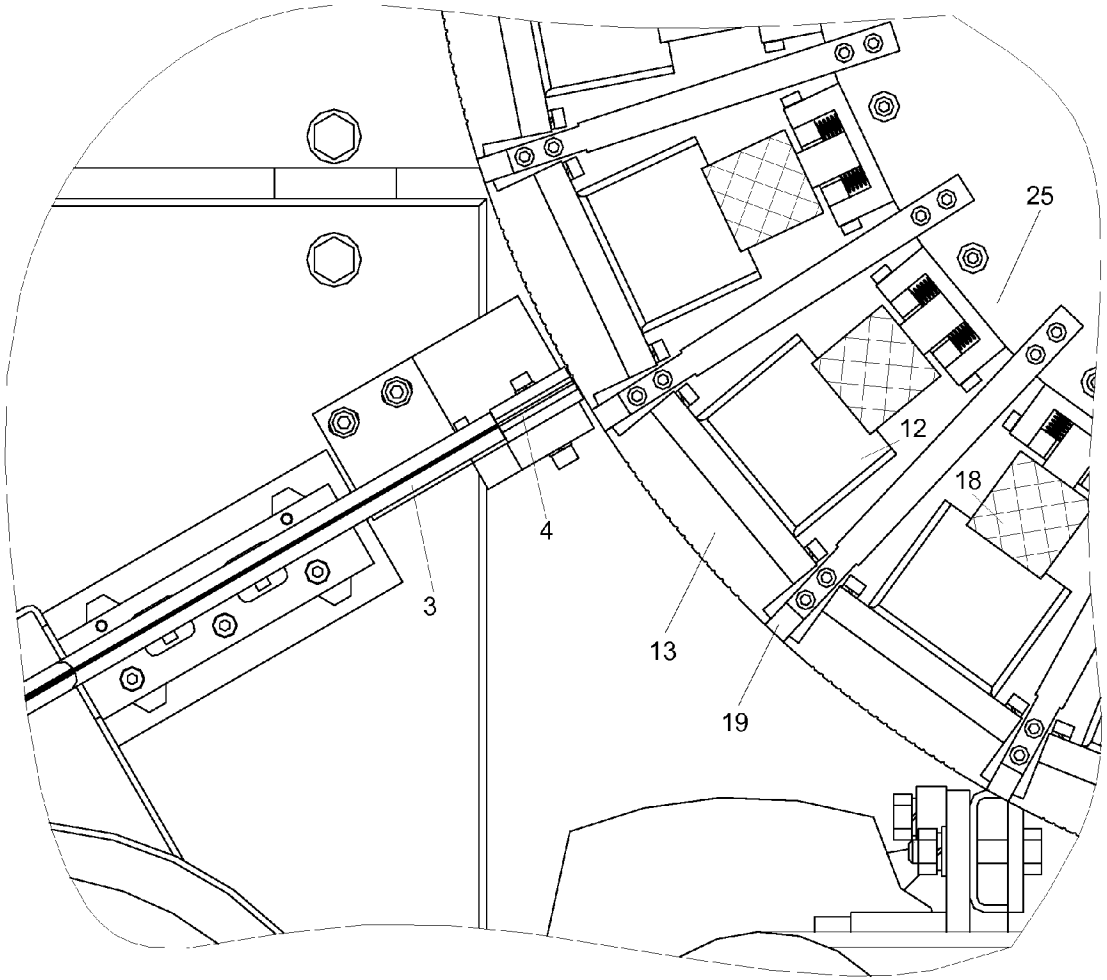
FIG. 7A illustrates a top cross-sectional view of one section of the selective plating apparatus of the present invention.
Figure 7B:
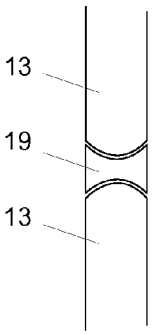
FIG. 7B illustrates an exemplary embodiment of a profile insert closing the gap between the rotary mechanisms of the selective plating apparatus of the present invention.

In accordance with the preferred embodiment of the present invention, the rotary mechanisms 25 are attached along the circumference of the support wheel 8 as partially illustrated in FIG. 7A. To allow for the full 180 degree rotation of the friction roller 18 together with the rotary attachment base 12 and the interchangeable segment 13 holding the parts, it is preferable to have a space between the interchangeable segments 13. However, if the space is unfilled, the parts received from the product guide 4 will fall through the space and will not be picked up by the interchangeable segment 13. To remedy this possible problem, a profile insert 19 may be inserted in between the rotary mechanisms so as to fill the space between the interchangeable segments 13. The profile insert 19 is shaped in such a way as to allow free rotation of the segments. FIG. 7B illustrates one embodiment of the shape of the profile insert 19.

Figure 3:
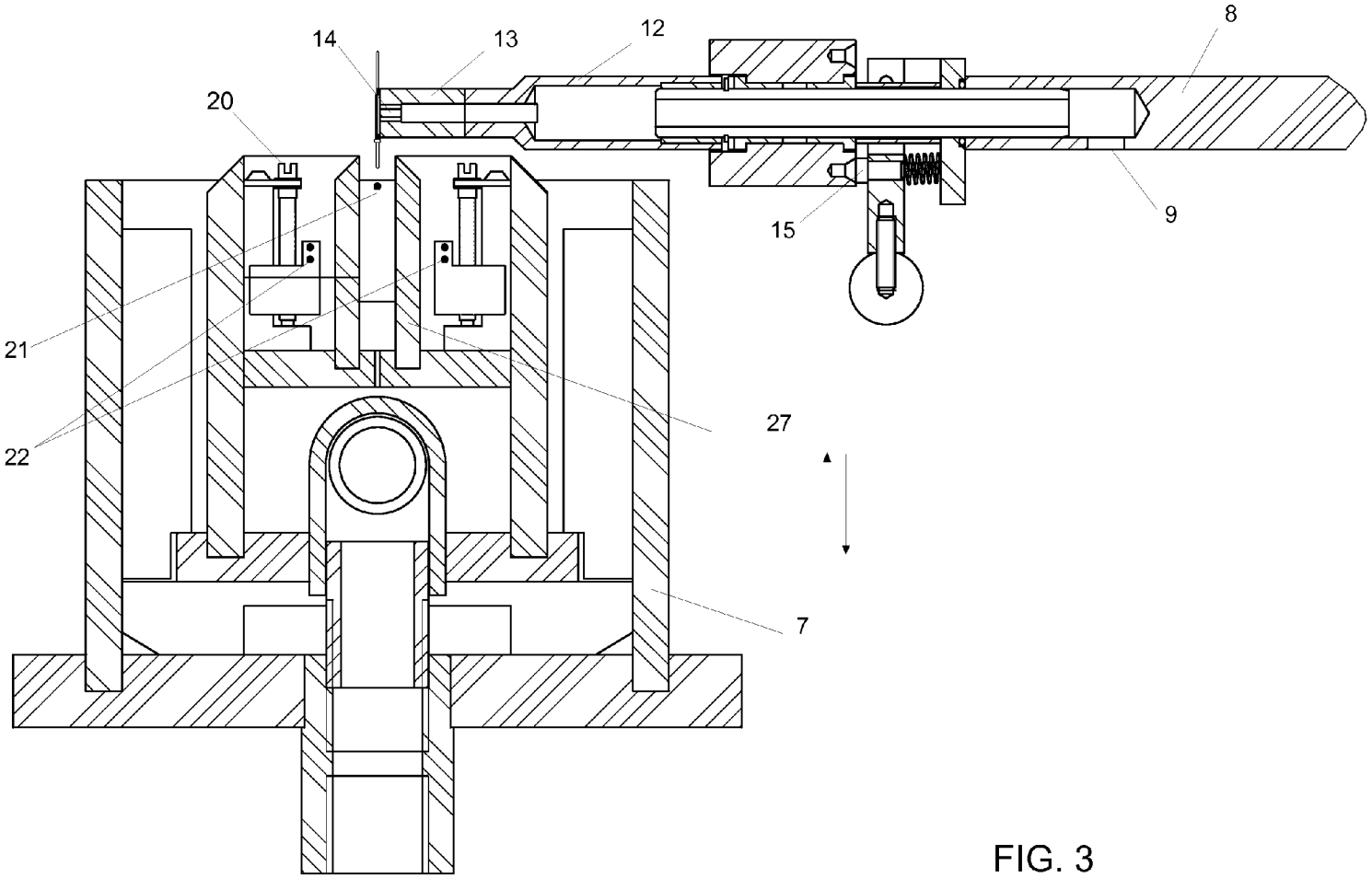
FIG. 3 illustrates a side cross-sectional view of the support wheel, the rotating mechanism and the plating tank of the selective plating apparatus of the present invention.

As illustrated in FIG. 3, the one or more plating baths 21 inside the plating tank 7 are positioned co-axially with the support wheel 8 so that the path traced by the part passes through the successive baths disposed on the same pitch circle diameter. For example, a typical sequence may include electrolytic cleaning, rinsing, acid drip, rinse, gold plate, drag out, rinse and hot air dry. The parts are unloaded after the air drying step and this coincides with the end region of the pressure belt 6. Thus, as the pressure belt 6 leaves contact with the support wheel 8 the parts fall away into a collection bin (not shown).

The amount or depth of the part being plated may be varied by raising or lowering the plating tank 7. The plating tank 7 may utilize slotted wires 20 through which the parts pass. Liquids are pumped from reservoirs below into the plating tank where they overflow the slotted wires 20 and leveling gates at the sides of the tank to return to the respective reservoir underneath.

Plating is carried out in the plating tank 7 by direct current supplied between outside anodes 22 placed in the plating tank 7, and the parts to be plated which are made as cathodes by the contact with the support wheel 8 connected to the negative output of a suitable rectifier. The pressure belt 6 may serve to ensure firm electrical contact between the parts and the support wheel 8. In the case of socket plating which requires internal plating, a profiled mask can be fitted to the interchangeable segment 13 fixed onto the support wheel 8 and the belt extended so that the outer surface of the part is protected.

Figures 8A, 8B, 8C:
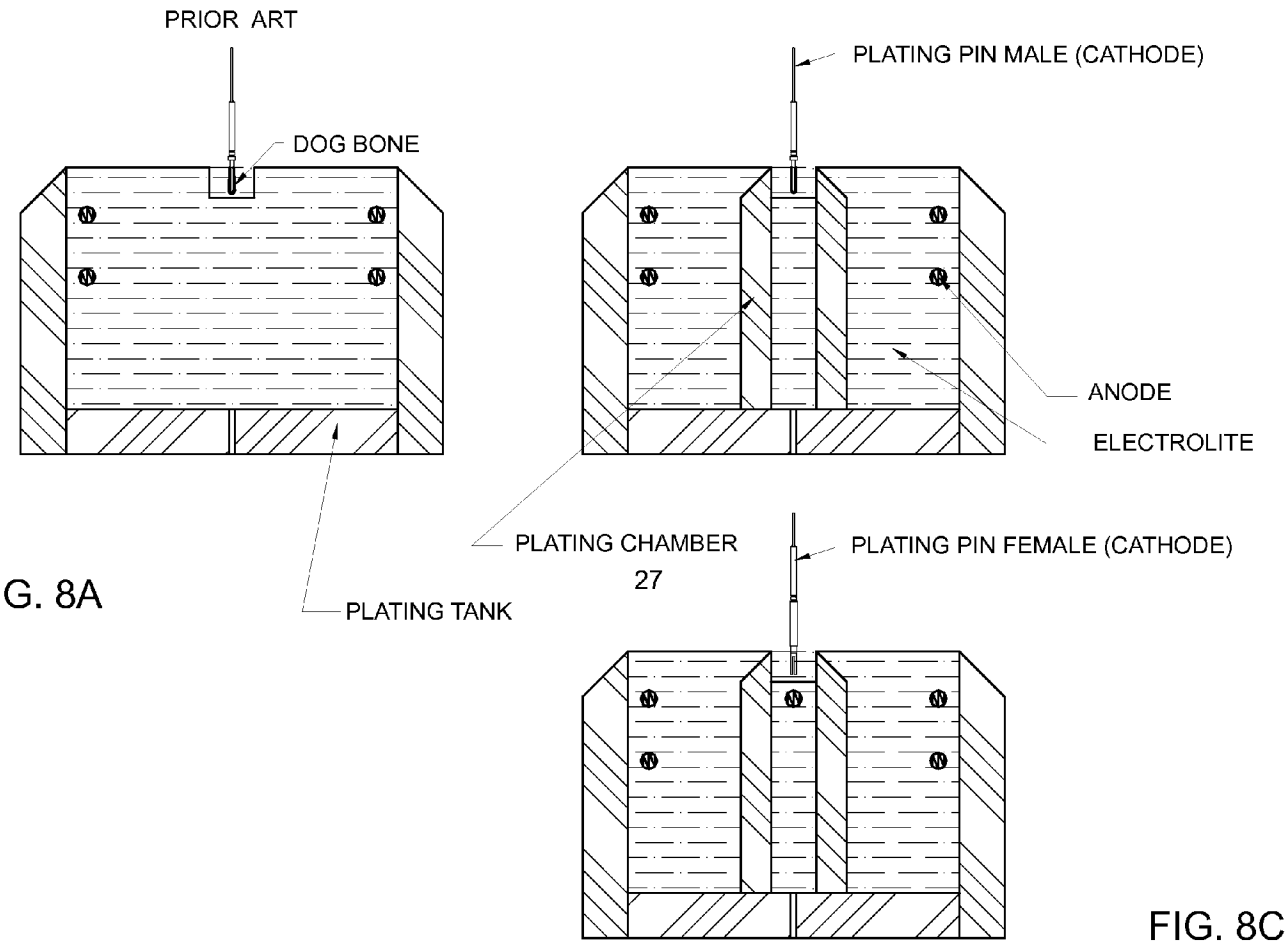
FIG. 8A illustrates a side cross-sectional view of a plating tank used in prior art.
FIGS. 8B and 8C illustrate a side cross-sectional view of an exemplary plating tank according to one embodiment of the present invention.

In accordance with the preferred embodiment of the present invention, the plating tank 7 comprises a plating chamber 27 as illustrated FIG. 3. As described above, referring to FIGS. 8A, 8B and 8C, the part to be plated is a cathode and the anode is made of metal or alloy to be plated on the part. When both components are immersed in an electrolyte solution with a direct current applied to the anode, the dissolved metal ions from the anode are plated onto the cathode. In case of the parts with sharp edges as illustrated in FIG. 8A, a high current density at sharp edges causes more metal to be plated than on flat surfaces of the same part. This undesired result is called a dog bone effect. To remedy this, a separate plating chamber 27 is created inside the plating tank 7 which facilitates a more even distribution of the plating deposit throughout the contact surface of the part.

Those skilled in the art will recognize that nearly any conductor may be used for the electrodes utilized by the present invention and not limited to the specific materials specified above.

The apparatus and method described above may also be used for plating parts assembled in a bandolier, preformed strip, plain strip, and spot or strip plating with suitable peripheral masks and belts. This can be achieved with simple modification of the above described apparatus. The apparatus may easily be adapted to accept preformed strip in reel-to-reel fashion, where unplated strip is fed straight from a reel into the selective plating apparatus and loaded onto a reel at the end of the plating process at the unloading section.

While the selective plating apparatus of the present invention has been described with reference to use in a plating machine for which it is particularly suited, it will be appreciated that it is equally suited to conveying any loose parts to be processed and transferred from one point to another and which have to be separated during transit.

All publications and patents mentioned in the above specification are incorporated by reference in this specification. Various modifications and variations of the described detector(s) and its components will be apparent to those skilled in the art without departing from the scope and spirit of the invention. Although the disclosure has been described in connection with specific preferred embodiments, it should be understood that the invention as claimed should not be unduly limited to such specific embodiments. Indeed, those skilled in the art will recognize, or be able to ascertain using no more than routine experimentation, many equivalents to the specific embodiments of the invention described herein. Such equivalents are intended to be encompassed by the following claims.

We claim:

1. A selective plating apparatus for plating contact surfaces of parts using a plating solution bath, comprising:

a vibrobowl for storing and separating the parts;

a vibratory linear feeder attached to the vibrobowl for moving the parts via linear vibration, wherein the linear feeder includes a product guide for holding the parts;

a support wheel for continuously and rotationally moving the parts from the linear feeder to the plating solution bath for plating;

a plurality of rotary mechanisms for receiving the parts from the vibratory linear feeder and for rotating the parts based on the contact surface to be plated, wherein each rotary mechanism comprises a rotary attachment base attached to the support wheel along the circumference and capable of being rotated in a plane perpendicular to the circumference of the support wheel and an interchangeable segment removably attached to the attachment base for holding the parts;

a pressure belt attached to the support wheel for holding the parts during movement and plating.

2. The selective plating apparatus of claim 1, wherein the contact surfaces of the parts are interior.

3. The selective plating apparatus of claim 1, further comprising a vacuum chamber underneath the support wheel for generating air pressure throughout the selective plating apparatus.

4. The selective plating apparatus of claim 3, wherein the support wheel includes vacuum holes for holding the parts via the air pressure generated by the vacuum chamber.

5. The selective plating apparatus of claim 4, wherein the air pressure is holding the parts on the support wheel until the pressure belt takes over.

6. The selective plating apparatus of claim 1, further comprising a plurality of pulleys for providing tension to the pressure belt.

7. The selective plating apparatus of claim 1, further comprising a drive system for electrically driving the pressure belt around the support wheel.

8. The selective plating apparatus of claim 1, further comprising a plating tank housing the plating solution bath for plating the parts.

9. The selective plating apparatus of claim 8, wherein the plating tank housing may be raised or lowered.

10. The selective plating apparatus of claim 8, wherein the plating tank includes a plating chamber for housing the plating solution bath.

11. The selective plating apparatus of claim 1, further comprising a face cam in contact with the plurality of the rotary mechanisms during the rotation of the support wheel for rotating the parts.

12. The selective plating apparatus of claim 11, wherein the face cam includes a friction plate for making contact with the rotary mechanism.

13. The selective plating apparatus of claim 11, wherein the face cam includes a gear on rack device for making contact with the rotary mechanism.

14. The selective plating apparatus of claim 1, wherein the plating solution bath comprises a precious metal.

15. The selective plating apparatus, of claim 14, wherein the precious metal is gold.

16. The selective plating apparatus of claim 1, wherein the plating solution bath comprises a non-precious metal.

17. The selective plating apparatus of claim 1, further comprising a plurality of profile inserts placed in between the rotary mechanisms to close gaps on the support wheel.

* * * * *